US008135154B2

(12) United States Patent
Krämer

(10) Patent No.: US 8,135,154 B2
(45) Date of Patent: Mar. 13, 2012

(54) SWITCH ARRANGEMENT AND METHOD FOR CHANGING OVER A HEARING DEVICE

(75) Inventor: Wolfgang Krämer, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 890 days.

(21) Appl. No.: 12/221,663

(22) Filed: Aug. 5, 2008

(65) Prior Publication Data

US 2009/0042426 A1 Feb. 12, 2009

(30) Foreign Application Priority Data

Aug. 6, 2007 (DE) ..... 10 2007 037 025

(51) Int. Cl.
*H04R 25/00* (2006.01)

(52) U.S. Cl. ..... 381/330; 381/322; 381/323; 381/324

(58) Field of Classification Search ..... 381/322–324, 381/330

See application file for complete search history.

(56) References Cited

U.S. PATENT DOCUMENTS

| | | | | |
|---|---|---|---|---|
| 5,347,584 | A * | 9/1994 | Narisawa | 381/323 |
| 5,404,407 | A * | 4/1995 | Weiss | 381/314 |
| 2007/0036380 | A1 * | 2/2007 | Kral et al. | 381/324 |
| 2009/0110222 | A1 * | 4/2009 | Heerlein et al. | 381/323 |
| 2009/0136069 | A1 * | 5/2009 | Heerlein et al. | 381/323 |

FOREIGN PATENT DOCUMENTS

| | | | |
|---|---|---|---|
| DE | 29602921 | U1 | 5/1996 |
| DE | 102005037897 | B3 | 4/2007 |

* cited by examiner

*Primary Examiner* — Andy Huynh

(57) ABSTRACT

Switch arrangement for hearing devices, which includes a connector socket which can be covered by a socket cover. The connector socket and the socket cover are arranged and embodied such that an electrical switching contact can be produced by applying pressure to the socket cover covering the connector socket. A method for changing over programs in hearing devices with a behind-the-ear part is also specified, in which an electrical switching contact is produced by means of a connector socket of the behind-the-ear part and its socket cover. Space can be saved as a result.

7 Claims, 4 Drawing Sheets

SWITCH ARRANGEMENT AND METHOD FOR CHANGING OVER A HEARING DEVICE

CROSS REFERENCE TO RELATED APPLICATIONS

This application claims the benefits of German application No. 10 2007 037 025.5 filed Aug. 6, 2007 and is incorporated by reference herein in its entirety.

FIELD OF INVENTION

The invention relates to a hearing device having a connector socket which can be covered by a socket cover and a method for changing over a hearing device.

BACKGROUND OF THE INVENTION

Numerous hearing devices are able to select different audio programs by pushing a button. To this end, the behind-the-ear part of the hearing device has a pushbutton.

Modern hearing devices also have a programming socket, for instance according to the CS44 standard, by way of which an individual programming of the hearing device is possible.

The pushbutton for program selection generally requires a separate control element, since it is in most instances designed to be very small. To this end, a plastic button is used in many cases, which presses on a membrane pushbutton. The button simultaneously represents a cover and a protective mechanism for the membrane switch.

An additional cover is generally provided for the programming socket. This is used for this purpose to protect the electrical contacts of the programming socket against contamination.

Patent application DE 10 2005 037 897 B3 specifies a hearing device of this type. This includes a programming switch for switching into several audio programs, a programming socket for connecting the hearing device to a programming device, as well as a cover facility, which is embodied in one piece and covers both the programming switch and also the programming socket, with the cover facility having a locking element, with which it is held in a removable fashion on the programming switch and the programming socket when in the covering state and with the cover facility being marginally moveable in the covering state, so that the programming switch can be actuated as a result of the movement.

SUMMARY OF INVENTION

It is the object of the invention to specify an additional switch arrangement for hearing devices, which saves space on the hearing device.

According to the invention, the set object is achieved by the apparatus by the features cited in the claims, by a connector socket and the associated socket cover being arranged and embodied such that an electrical switching contact can be produced by applying pressure to the socket cover covering the connector socket.

The invention is advantageous in that small and aesthetically pleasing housings can be produced without restricting the functionality, since space is saved as a result of a combination of switch and socket.

In one embodiment, the connector socket includes at least one contact pin and the socket cover includes at least one electrically conductive contact element which is connected to an electrical circuit, with it being possible to produce the electrical switching contact between the at least one contact pin and the at least one contact element.

In a further embodiment, the connector socket includes at least two contact pins and the socket cover includes at least one non-contacted contact element, in other words without a connection to an electrical switching circuit, which is embodied in an electrically conductive fashion, with it being possible to produce the electrical switching contact by connecting the two contact pins by means of the contact element.

Contact pins provided for a pressure contact may also be longer than the remaining contact pins.

These embodiments are advantageous in that a reliable switching contact is ensured.

In a further embodiment, the connector socket is designed according to industry standard CS44.

This is advantageous in that a standard programming cable can be used for programming purposes.

In a further embodiment, the behind-the-ear part of a hearing device includes an above-described inventive switch arrangement.

This is advantageous in that small, space-saving, aesthetically pleasing hearing device housings can be used.

The socket cover of a hearing device can comprise a locking element, with which it can be held in a removable fashion on the connector socket in the covering position.

The socket cover of a hearing device can include a swivel, which is connected to the behind-the-ear part such that the socket cover can be pivoted about the swivel.

The features of the claims specify an inventive method for changing over hearing devices with a behind-the-ear part, with a connector socket of the behind-the-ear part and its socket cover being actively connected to one another such that an electrical switching contact is produced after applying pressure to the socket cover covering the connector socket and a changeover between different programs stored in the behind-the-ear part is effected as a result.

This is advantageous in that it is possible with the socket cover to changeover between stored audio programs without an additional pushbutton.

BRIEF DESCRIPTION OF THE DRAWINGS

Further characteristics of the invention are apparent from the descriptions of an exemplary embodiment below with reference to schematic drawings, in which.

DETAILED DESCRIPTION OF INVENTION

Figure 1:
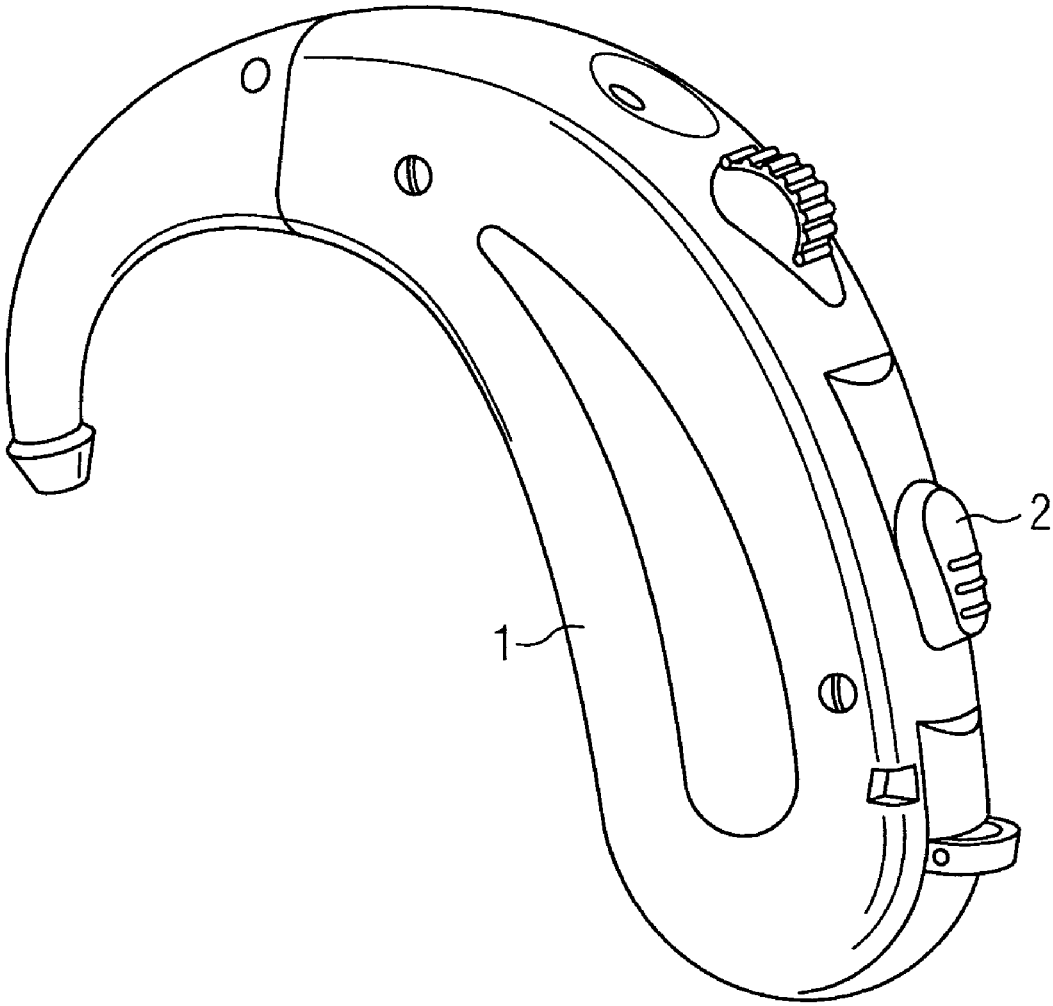
FIG. 1: shows a behind-the-ear part of a hearing device.

FIG. 1 shows a behind-the-ear part with a hearing device shell 1, which has a socket cover 2. The socket cover 2 is also used as a control element for a switch formed from socket cover 2 and connector socket disposed therebelow (not shown in FIG. 1). Applying pressure to the socket cover 2 triggers a switching contact in accordance with the invention, which makes it possible to change over between different audio programs for instance.

Figure 2:
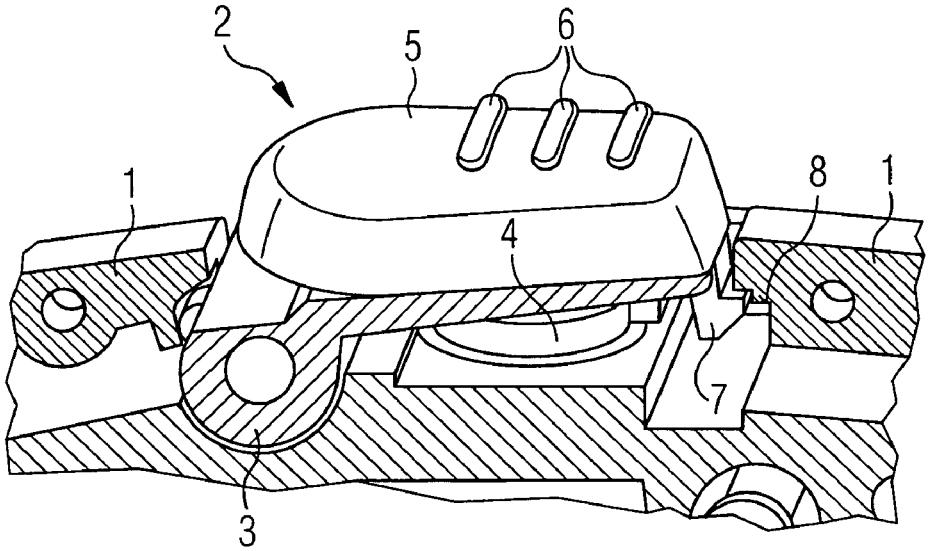
FIG. 2: shows a section through a behind-the-ear part.

FIG. 2 shows an enlarged representation of the closed socket cover 2 and sections of the hearing device shell 1. The socket cover 2 is pivotably mounted on a swivel 3.

A connector socket 4 is apparent below the socket cover 2, which connector socket is used as a programming socket and as a programming switch. The connector socket 4 is connected to a signal processing of the hearing device (not shown) by way of a cable (not shown). The connector socket 4, for instance designed according to the CS44 standard, allows the hearing device to be individually programmed by connecting to a programming device (not shown).

The socket cover 2 is embodied in one piece, as an injection molded part for instance. It has the swivel 3 and a raised control section 5 with grooves 6 for enhancing the grip at its free end. The connector socket 4 is positioned in the covering state of the socket cover 2 shown in FIG. 2 below the raised control section 5, which is formed like a bell.

Figure 3:
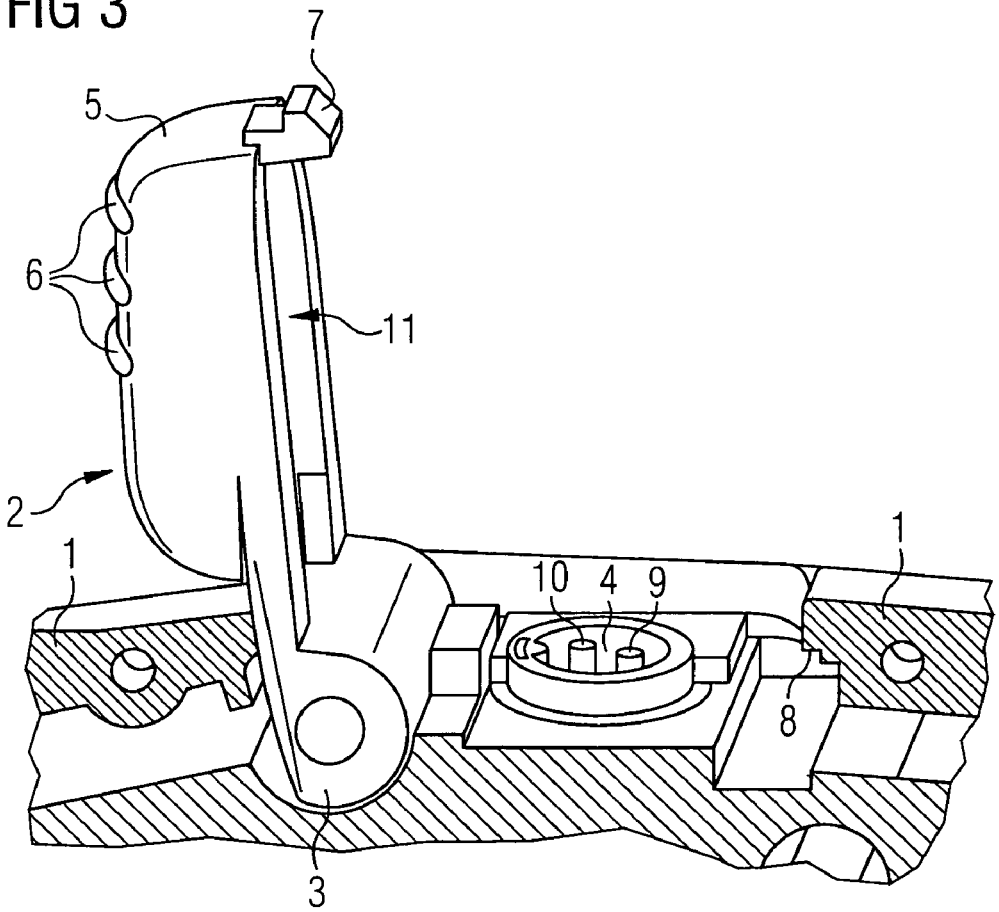
FIG. 3: shows a further section through a behind-the-ear part.

A cast hook 7 as a locking element is disposed at the outer free end of the socket cover 2, in other words at the tip of the control section 5. When in a closed state, this hook 7 engages below a shoulder 8 of the hearing device shell 1. The hook 7 is embodied as a snap-on element and locks the socket cover 2 in the covering state. For opening purposes, the hook 7 can be pushed back by means of a small screwdriver for instance, so that the socket cover 2 can be pivoted as shown in FIG. 3. The socket cover 2 can be pivoted up by at least 90 degrees about the swivel 3.

FIG. 3 shows the socket cover 2 according to FIG. 2 in the pivoted-up position. FIG. 3 shows that the control section 5 is hollow. A contact element (not shown), in the form of a copper strip for instance, is located in this hollow region 11 of the socket cover 2. The contact element is connected to the signal processing (not shown) and is used to connect to one of the contact pins 9, 10 of the connector socket 4. To this end, a contact pin 10 is designed to be somewhat longer than the other 9, in order to exclusively produce the contact between the contact element of the socket cover 2 and the longer contact pin 10 in the covering state of the socket cover 2 when applying pressure to the control section 5 of the socket cover 2. By establishing this contact, different audio programs are changed over using the signal processing.

In order to actuate the switch arrangement, the socket cover 2 can be moved somewhat downwards in the direction of the connector socket 4 when the socket cover 2 in FIG. 2 is in a covering state. In this way, the contact element of the socket cover 2 touches the longer contact pin 10 and closes an electric circuit, which is identified by the signal processing.

To ensure a reliable actuation of the switch arrangement, and prevent an unintentional actuation, a spring element (not shown) is integrated in the swivel 3, which holds the socket cover 2 at a few tenths of a millimeter away from the connector socket 4 when the socket cover 2 in FIG. 2 is in the covering state and thus ensures a defined distance between the contact element of the socket cover 2 and the contact pins 9, 10. Alternatively, the edge of the connector socket can also be provided with an elastically deformable rubber ring for instance, which ensures a defined distance between the contact element of the socket cover 2 and the contact pins 9, 10 of the connector socket 4. In order to actuate the switch arrangement, the rubber ring can be easily pressed down.

Figure 4:
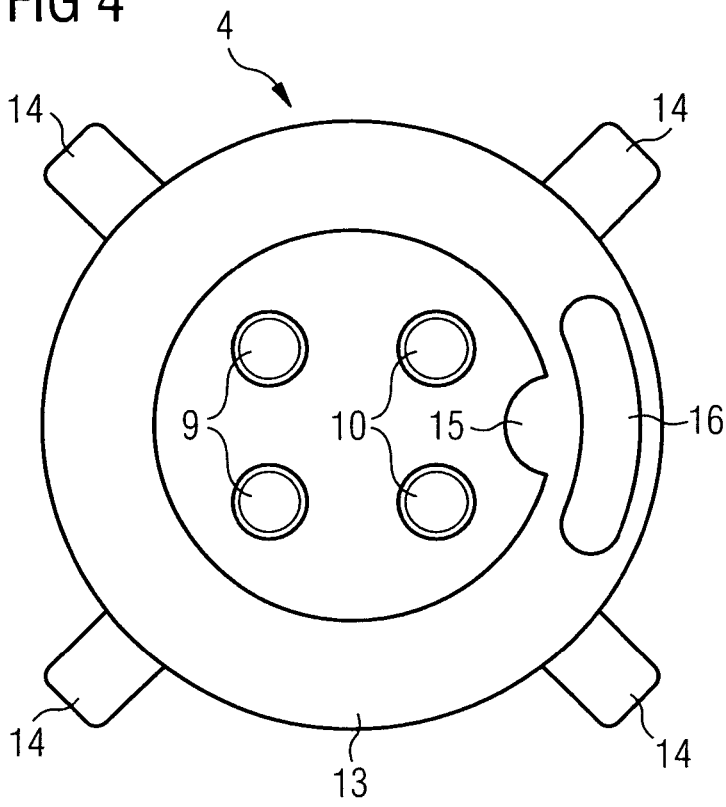
FIG. 4: shows a top view onto a connector socket.
Figure 5:
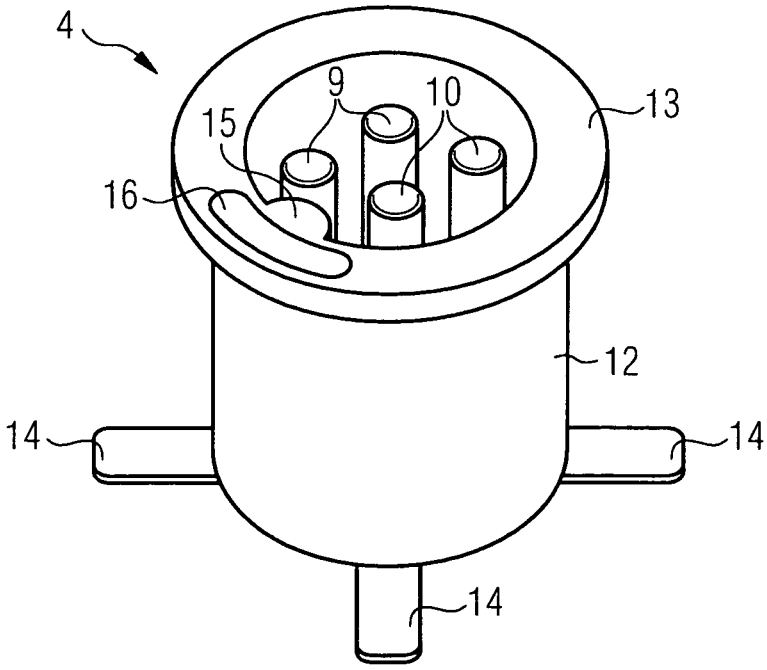
FIG. 5: shows a perspective view of a connector socket.

FIGS. 4 and 5 show an SMD connector socket 4 of an additional inventive exemplary embodiment with four contact pins 9, 10, two of which contact pins 10 are longer than the other two 9.

The connector socket 4 has a cylindrical plastic casing 12, onto which a flange 13 is injection-molded. Four contact pins 9, 10 in the form of metal pins are injection-molded into the interior of the connector socket 4, according to the insert-mold method. At the injection-molded end, each contact pin 9, 10 has a solder connection section 14, to which it is connected in one piece. The solder connection sections 14 point outwards in the manner of a star. In another embodiment, the solder connection sections 14 can also be embodied completely under the casing 12.

One of the four contact pins 9, 10 shown is used for the power supply and the rest for the signal lines. Two contact pins 10, for instance the one connected to ground but not simultaneously the one for the power supply, are designed to be longer than the two other contact pins 9. As a result, the contact pins 10 can be shorted by means of a contact element which is attached in the socket cover 2 (not shown) in a non-contacted manner and effect a switching contact by way of the signal lines and a signal processing.

A lug 15 runs parallel to the contact pins 9, 10 on the inner surface of the casing 12. Reverse polarity of a programming connector with the connector socket 4 is prevented with the aid of the lug 15.

A banana-shaped curved optical marker 16, which can also be designed as a simple point, is also positioned on the surface of the flange 13. The marker 16 is for automatic detection by means of an optical recognition system, so that the connector socket 4 can be automatically oriented and positioned correctly in a pick-and-place machine.

The connector socket according to FIGS. 4 and 5 can be easily integrated into a hearing device according to FIG. 1 to 3.

Figure 6:
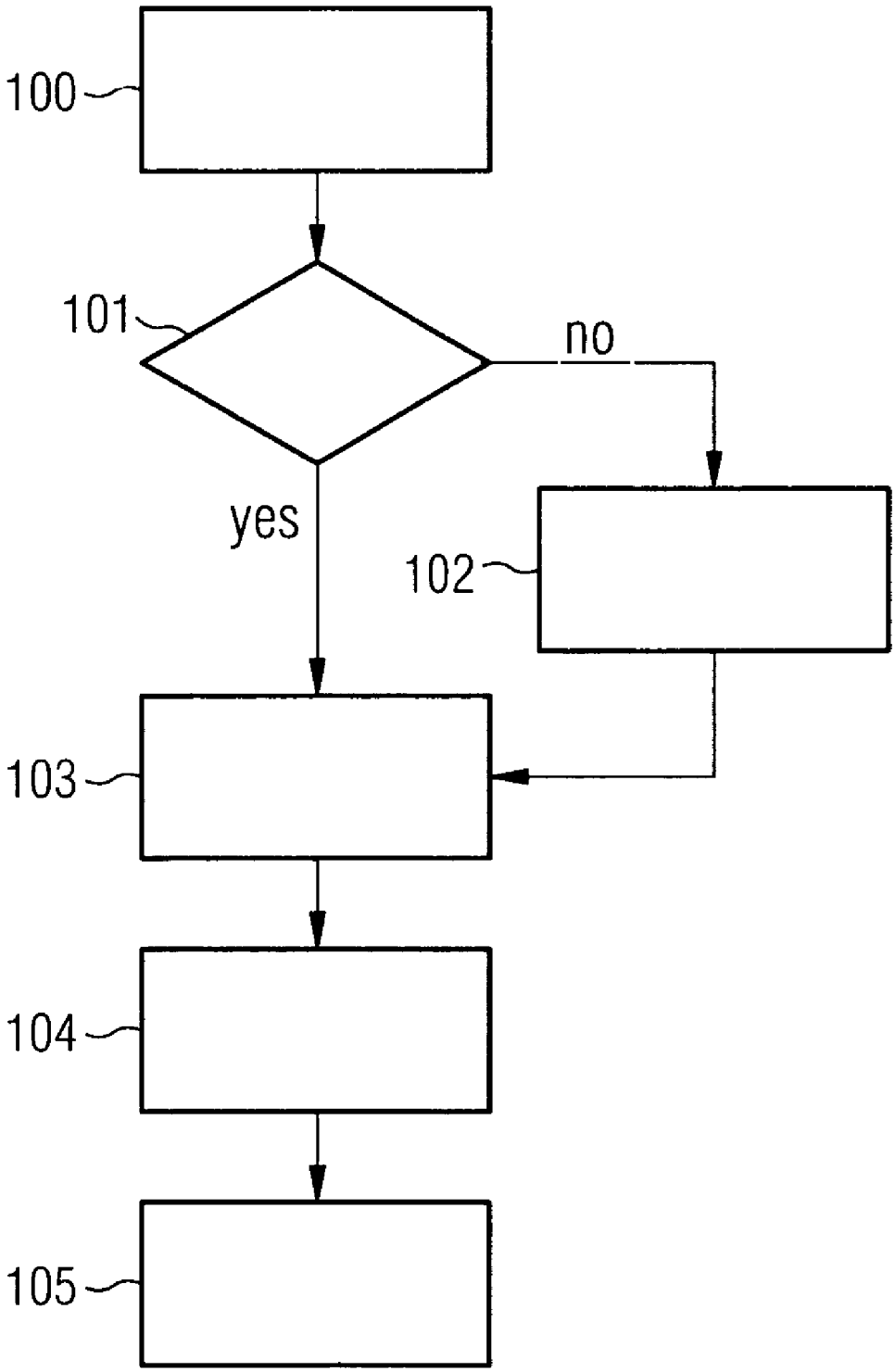
FIG. 6: shows a flow chart.

FIG. 6 shows the essential method steps when changing over a hearing device using an inventive switch arrangement. In step 100, a hearing device is provided. In step 101, a check is carried out as to whether the socket cover 2 of the hearing device is in the covering state, in other words is closed. If the answer is no, the socket cover 2 is closed in step 102. In the subsequent step 103, pressure is applied to the control section 5 of the socket cover 2. In step 104, a switching contact is produced, which effects a changeover between different audio programs in the hearing device for instance in the subsequent step 105.

The invention claimed is:

1. A switch arrangement for hearing devices, comprising:

a coverable connector socket comprising a plurality of contact pins, wherein a contact pin provided for a pressure contacting is longer than remaining contact pins; and a socket cover arranged to cover the connector socket and comprising an electrically conductive contact element connected to an electrical circuit, the socket cover configured such that by applying pressure to the socket cover an electrical switching contact is produced between the contact pin provided for pressure contacting and the contact element.

2. The switch arrangement as claimed in claim 1, wherein the plurality of contact pins comprise a first and a second contact pin provided for the pressure contacting and the electrical switching contact is produced between the first and third contact pins and the contact element.

3. The switch arrangement as claimed in claim 1, wherein the connector socket is designed in accordance with industry standard CS44.

4. A hearing device with a behind-the-ear portion, comprising:

a hearing device shell;

a coverable connector socket arranged on the hearing device shell, the connector socket comprising a plurality of contact pins, wherein a contact pin provided for pressure contacting is longer than remaining contact pins; and a socket cover arranged to cover the connector socket and comprising an electrically conductive contact element connected to an electrical circuit, the socket cover configured such that by applying pressure to the socket cover an electrical switching contact is produced between the contact pin provided for pressure contacting and the contact element.

5. The hearing device as claimed in claim 4, wherein the socket cover has a locking element that holds the socket cover in a covering position over the connector socket in a removable fashion.

6. The hearing device as claimed in claim 5, wherein the socket cover comprises a swivel which is connected to the behind-the-ear portion such that the socket cover pivots about the swivel.

7. A method for changing over hearing devices with a behind-the-ear part, comprising:

associating a connector socket of the behind-the-ear part and a socket cover, the connector socket comprising a plurality of contact pins, wherein a contact pin provided for pressure contacting is longer than remaining contact pins, the socket cover comprising an electrically conductive contact element connected to an electrical circuit;

actively connecting the connector socket of the behind-the-ear part and its associated socket cover;

producing an electrical switching contact after applying pressure to the socket cover covering the connector socket, the electrical switching contact produced between the contact pin provided for pressure contacting and the contact element; and effecting a changeover between different programs stored in the behind-the-ear part as a result of the electrical switching contact.

* * * * *